US007108620B1

(12) United States Patent
Yiu

(10) Patent No.: US 7,108,620 B1
(45) Date of Patent: Sep. 19, 2006

(54) GAME DART HAVING BALLAST

(76) Inventor: Chih Hao Yiu, 6F-2, No. 160, Sec. 1, Jhonggang Road, West Dist., Taichung 403 (TW)

( * ) Notice: Subject to any disclaimer, the term of this patent is extended or adjusted under 35 U.S.C. 154(b) by 47 days.

(21) Appl. No.: 11/035,000

(22) Filed: Jan. 12, 2005

(51) Int. Cl.
*A63B 65/02* (2006.01)

(52) U.S. Cl. ..... 473/578

(58) Field of Classification Search ..... 473/578
See application file for complete search history.

(56) References Cited

U.S. PATENT DOCUMENTS 5,009,433 A * 4/1991 Reid ..... 473/582
5,058,900 A * 10/1991 Denen ..... 473/570
5,498,004 A 3/1996 Mariella et al. ..... 273/416
5,895,331 A 4/1999 Rinehart ..... 423/578
6,974,398 B1 * 12/2005 Murphy ..... 473/578

FOREIGN PATENT DOCUMENTS

GB 2086243 A 5/1982

* cited by examiner

*Primary Examiner*—John A. Ricci
(74) *Attorney, Agent, or Firm*—Charles E. Baxley

(57) ABSTRACT

A game dart includes a dart barrel having a hollow chamber and front and rear ends each having a screw hole communicating with the hollow chamber. A ballast is retained in the chamber of the dart barrel, and includes two ends each having an engaging member for suspending the ballast in the chamber of the dart barrel, a dart point and a longitudinal flight shaft each includes a threaded coupler for detachably threading with the screw holes of the ends of the dart barrel, and the shaft includes a flight attached to the trailing end. The ballast may be molded within the dart barrel, and the dart barrel may have the screw holes directly formed in the ends for threading with the dart point and the shaft.

3 Claims, 3 Drawing Sheets

GAME DART HAVING BALLAST

BACKGROUND OF THE INVENTION

1. Field of the Invention

The present invention relates to a game dart, and more particularly to a game dart having a ballast for stabilizing or balancing the game dart.

2. Description of the Prior Art

Various kinds of typical game darts have been developed and comprise a dart barrel including a needle like dart point extended forwardly therefrom, and including a longitudinal flight shaft extended rearwardly therefrom, and the trailing end of the shaft being terminated by a flight.

For example, U.S. Pat. No. 5,498,004 to Mariella et al. discloses one of the typical game darts comprising a longitudinal flight shaft detachably attached to a dart barrel by a threading engagement. However, the dart barrels of the typical game darts have no weight or ballast or other balancing members disposed therein such that the typical game darts may not be stabilized or balanced while shooting.

U.S. Pat. No. 5,895,331 to Rinehart discloses another typical game dart also comprising a longitudinal flight shaft detachably attached to a dart barrel by a threading engagement, and a needle like dart point also detachably attached to the dart barrel by a threading engagement, and a heavy and very malleable ballast material, such as a wad of the lead wool ballast is engaged into the dart barrel.

However, it will be inconvenient to insert the lead wool ballast into the dart barrels of the typical game darts, and thus expensive man power is required to assemble the typical game darts. In addition, for coupling or attaching the flight shaft and the dart point to the dart barrel, solid brass nose and tail bushings are further required to be provided and attached or secured onto the dart barrel, and having inner threads formed or provided therein, for threading and attaching the flight shaft and the dart point to the dart barrel, such that the typical game dart may not be quickly manufactured or assembled, and such that the manufacturing cost for the typical game dart will be greatly increased.

Great British Patent No. GB 2086243A to Halpern discloses a further typical game dart comprising a longitudinal flight shaft detachably attached to a dart barrel by a threading engagement, and a needle like dart point and a number of magnets attached to the dart barrel. However, the dart barrel is required to be pressed or spun with a recess therein, to solidly retain the needle like dart point and the magnets within the dart barrel, such that the needle like dart point and the magnets may not be easily engaged into and assembled to the dart barrel.

The present invention has arisen to mitigate and/or obviate the afore-described disadvantages of the conventional game darts.

SUMMARY OF THE INVENTION

The primary objective of the present invention is to provide a game dart including a ballast to be easily and quickly molded within the dart barrel of the game dart, for stabilizing or balancing the game dart.

The other objective of the present invention is to provide a game dart including a dart point and a longitudinal flight shaft and a trailing flight that may be easily and readily attached or coupled or secured to a dart barrel.

In accordance with one aspect of the invention, there is provided a game dart comprising a dart barrel including a hollow chamber formed therein, and including a front end and a rear end each having a screw hole formed therein, a ballast retained in the chamber of the dart barrel, the screw holes of the dart barrel including an inner diameter smaller than that of the chamber of the dart barrel, to form an inner peripheral shoulder in each of the ends of the dart barrel, and to engage with the ballast, and to anchor and retain the ballast within the hollow chamber of the dart barrel, a dart point including a threaded coupler for detachably threading with the screw hole of the front end of the dart barrel, for detachably attaching the dart point to the front end of the dart barrel, and a longitudinal flight shaft including a threaded coupler for detachably threading with the screw hole of the rear end of the dart barrel, and for detachably attaching the flight shaft to the rear end of the dart barrel, and the shaft including a trailing end having a flight provided thereon.

The ballast includes two ends each having an engaging member provided therein. The engaging members of the ballast may be cavities formed in the ends of the ballast.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
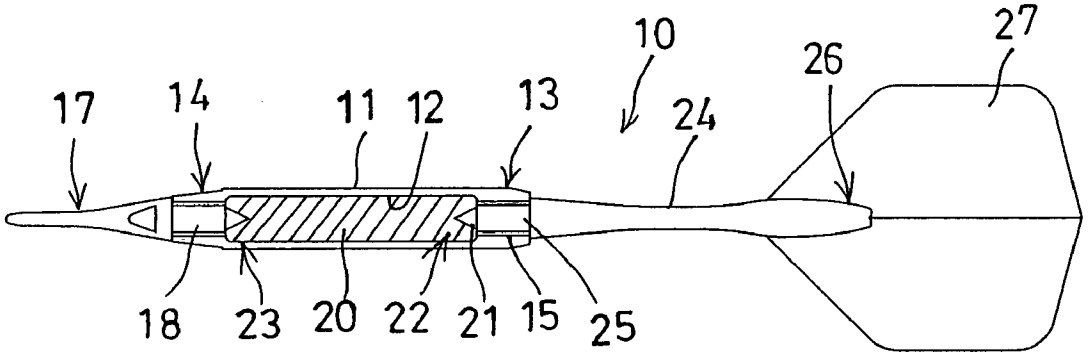
FIG. 1 is a partial cross sectional view of a game dart in accordance with the present invention.
Figure 2:
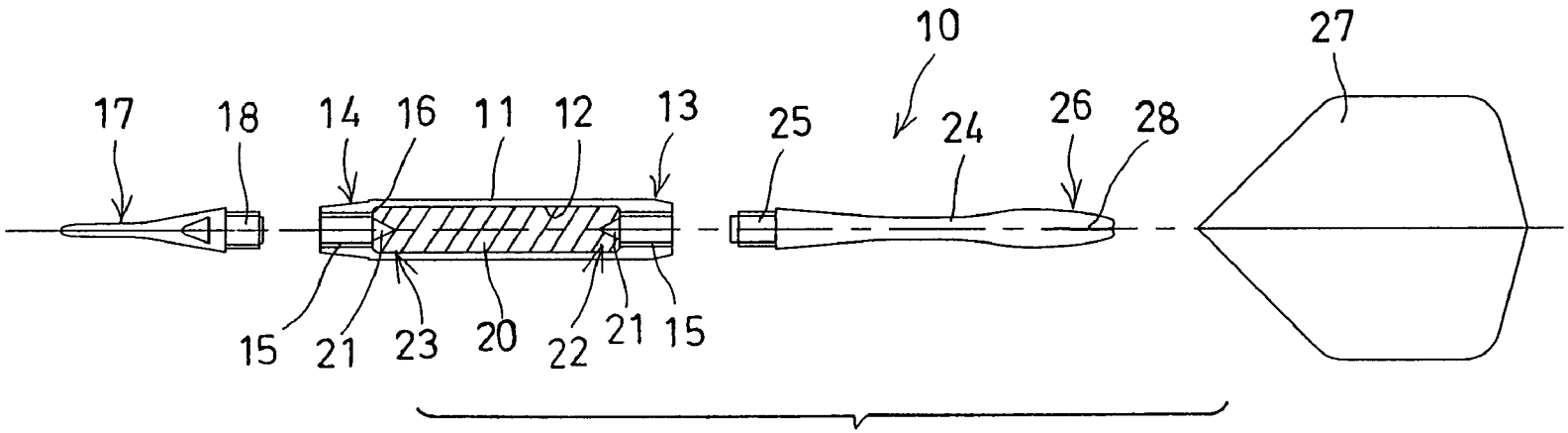
FIG. 2 is an exploded and partial cross sectional view of the game dart.

Referring to the drawings, and initially to FIGS. 1 and 2, a game dart 10 in accordance with the present invention comprises a dart barrel 11 including a hollow chamber 12 formed therein, for receiving a weight or balance element or ballast 20 therein, and including two ends 13, 14 each having a screw hole or an inner thread 15 formed therein and communicating with the hollow chamber 12 thereof.

It is preferable that the screw holes 15 of the dart barrel 11 include an inner diameter smaller than that of the hollow chamber 12 thereof, for forming or defining an inner peripheral shoulder 16 in each of the ends 13, 14 thereof, and for engaging with the weight or ballast 20, and thus for stably anchoring or retaining the weight or ballast 20 within the hollow chamber 12 of the dart barrel 11, and for preventing the weight or ballast 20 from being moved relative to the dart barrel 11.

The ballast 20 may be made of heavy materials, such as metal, plastic, or other materials, for balancing the dart barrel 11, and may be engaged into or formed within the hollow chamber 12 of the dart barrel 11 by such as molding or mold injection processes. It is preferable that the ballast 20 includes an engaging member 21, such as a cavity 21 formed or provided in each of the ends 22, 23 thereof, and communicating with the screw holes 15 of the dart barrel 11 respectively.

The game dart 10 further includes a needle like dart point 17 having a threaded coupler 18 for detachably threading with the screw hole 15 of the front end 14 of the dart barrel 11, and thus for detachably attaching to the front end 14 of the dart barrel 11, and further includes a longitudinal flight shaft 24 having a threaded coupler 25 for detachably threading with the screw hole 15 of the rear end 13 of the dart barrel 11, and thus for detachably attaching to the rear end 13 of the dart barrel 11.

The shaft 24 includes a trailing end 26 terminated by a flight 27. For example, the shaft 24 includes one or more grooves or slots 28 formed in the trailing end 26 thereof, for detachably attaching or securing the flight 27 to the shaft 24. The threading coupling of the dart point 17 and the shaft 24 to the dart barrel 11, and the attachment of the flight 27 to the shaft 24 are typical and will not be described in further details.

Figure 3:
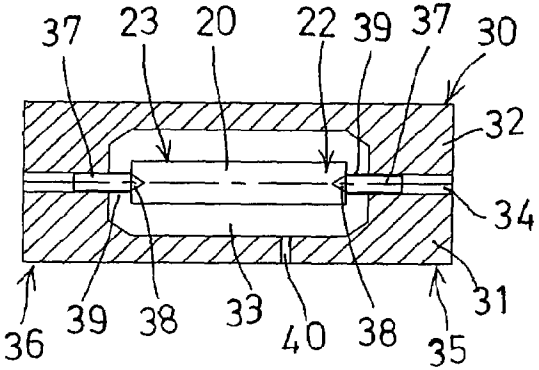
FIG. 3 is a partial cross sectional view illustrating a mold device for manufacturing a dart barrel of the game dart.
Figure 4:
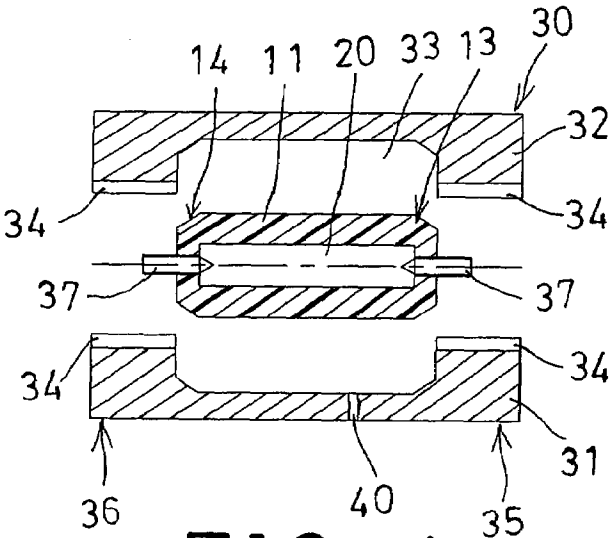
FIG. 4 is a partial exploded and cross sectional view illustrating the formation or the molding process of the dart barrel having the ballast engaged therein.

Referring next to FIGS. 3 and 4, illustrated is a mold device 30 for manufacturing or forming the dart barrel 11, and including a lower mold piece 31 and an upper mold piece 32, in which each of the mold pieces 31, 32 includes a mold cavity 33 formed therein and having a shape corresponding to that of the dart barrel 11, and each mold piece 31, 32 includes a recess 34 formed in each of two ends 35, 36 thereof and communicating with the mold cavities 33 thereof respectively.

Figure 5:
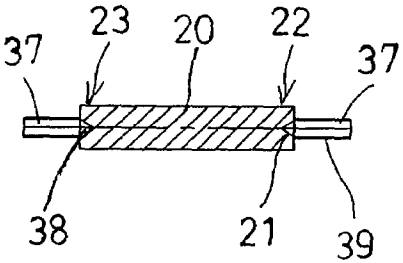
FIG. 5 is a partial cross sectional view illustrating an engagement of two anchoring pegs for engaging with and for positioning a ballast of the dart barrel of the game dart within a mold device.
Figure 6:
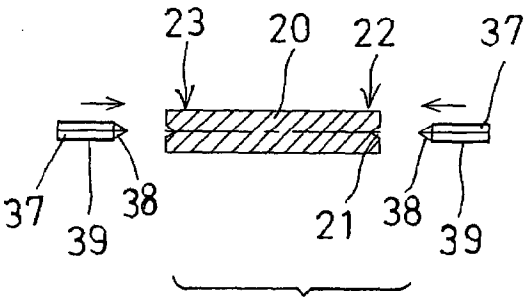
FIG. 6 is a partial exploded and cross sectional view illustrating the anchoring pegs for engaging with and for positioning the ballast of the dart barrel of the game dart within the mold device.

As shown in FIGS. 5 and 6, two anchoring pegs 37 are further provided and each includes another engaging member 38 or a tapered tip 38 provided on one end thereof for engaging into the corresponding cavities 21 of the ballast 20, and each includes an outer thread 39 formed thereon. The anchoring pegs 37 are partially received or engaged in the recesses 34 of the mold pieces 31, 32, and partially extended into the mold cavities 33 of the mold pieces 31, 32 respectively, to allow a portion of the outer threads 39 of the anchoring pegs 37 to be partially received or engaged in the mold cavities 33 of the mold pieces 31, 32 respectively, and to suspending and supporting the ballast 20 within the mold cavities 33 of the mold pieces 31, 32 respectively.

The mold device 30 includes one or more pouring gates 40 formed or provided in either or both of the mold pieces 31, 32, for filling or injecting a plastic or synthetic material into the mold cavities 33 of the mold pieces 31, 32, and for forming the body of the dart barrel 11, and thus for allowing the ballast 20 to be directly and quickly molded and secured within the hollow chamber 12 of the dart barrel 11 without further assembling processes, best shown in FIG. 4.

Figure 7:
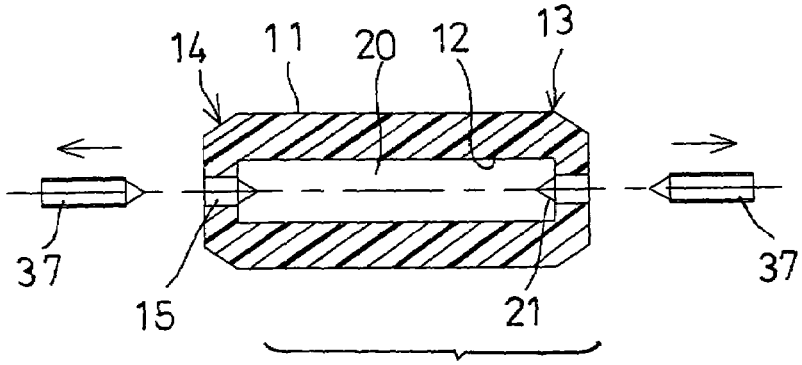
FIG. 7 is a partial exploded and cross sectional view illustrating the disengagement of the anchoring pegs from the dart barrel of the game dart.

As shown in FIG. 4, after the molding or mold injection processes, the dart barrel 11 and the ballast 20 and the anchoring pegs 37 may be removed from the mold pieces 31, 32 of the mold device 30. The anchoring pegs 37 may then be unthreaded and disengaged or removed from the dart barrel 11, as shown in FIG. 7, to form the corresponding screw holes 15 in the dart barrel 11 directly, without additional manufacturing or machining processes. The dart barrel 11 may be made of plastic materials, synthetic materials, or the like.

Figure 8:
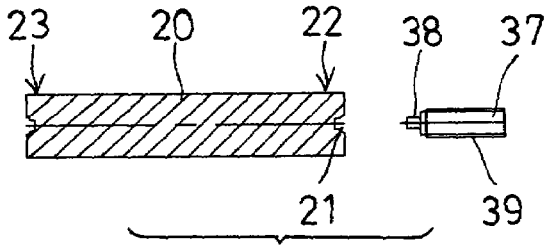
FIGS. 8, 9 are partial exploded and cross sectional views similar to FIG. 5, illustrating the other arrangements or embodiments of the anchoring pegs and the ballast for the dart barrel of the game dart.

Alternatively, as shown in FIG. 8, the engaging members 21 or the cavities 21 of the ballast 20, and the other engaging members 38 or the tapered tips 38 of the anchoring pegs 37 may be formed into the other shapes or configurations, for allowing the tapered tips 38 of the anchoring pegs 37 to be engaged into the cavities 21 of the ballast 20, and thus for stably retaining the ballast 20 within the mold cavities 33 of the mold pieces 31, 32 respectively.

Figure 9:
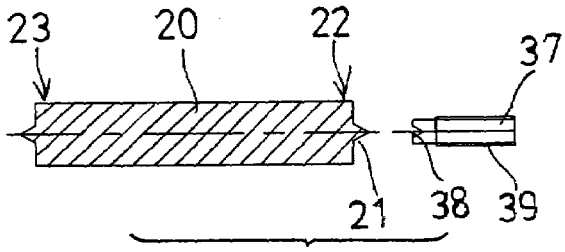

Further alternatively, as shown in FIG. 9, the engaging members 21 of the ballast 20 may be projected out from the ends 22, 23 of the ballast 20, and the other engaging members 38 of the anchoring pegs 37 may be formed in the end portion of the anchoring pegs 37, for allowing the engaging members 38, 21 of the anchoring pegs 37 and the ballast 20 to be engaged with each other, and to stably retain the ballast 20 within the mold cavities 33 of the mold pieces 31, 32 respectively.

It is to be noted that the ballast 20 may be directly and quickly and solidly molded and retained within the hollow chamber 12 of the dart barrel 11 without further assembling processes, and the screw holes 15 of the dart barrel 11 may also be directly and quickly formed within the dart barrel 11 without additional manufacturing or machining processes.

Figure 10:
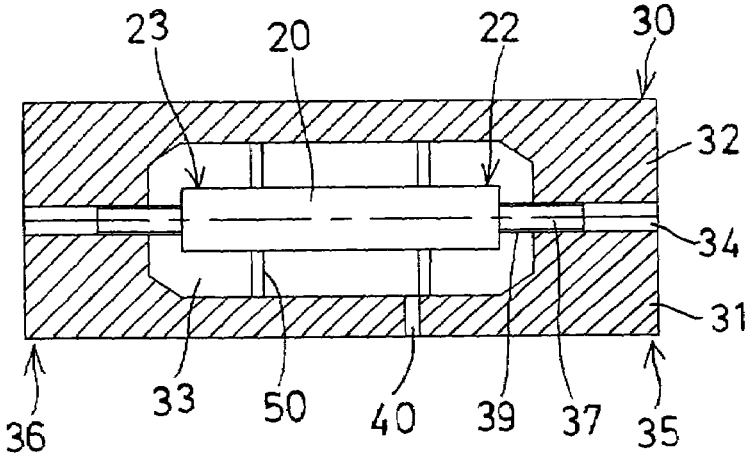
FIG. 10 is a partial cross sectional view similar to FIG. 3, illustrating another arrangement of the mold device for manufacturing the dart barrel of the game dart.

Alternatively, as shown in FIG. 10, the mold device 30 may include one or more positioning pins 50 attached to or extended from either or both of the mold pieces 31, 32, and extended into the mold cavities 33 of the mold pieces 31, 32, and engaged with the ballast 20, to retain or to suspend the ballast 20 within the mold cavities 33 of the mold pieces 31, 32.

With this arrangement, the anchoring pegs 37 are not required to be provided with the engaging members 38 or tapered tips 38 to engage with the ballast 20. The anchoring pegs 37 each also includes an outer thread 39 formed thereon and partially received or engaged in the recesses 34 of the mold pieces 31, 32, and also partially extended into the mold cavities 33 of the mold pieces 31, 32 respectively, to allow a portion of the outer threads 39 of the anchoring pegs 37 to be partially received or engaged in the mold cavities 33 of the mold pieces 31, 32 respectively, in order to transfer or to form the screw holes 15 in the dart barrel 11 directly, without additional manufacturing or machining processes.

Accordingly, the game dart in accordance with the present invention includes a ballast to be easily and quickly molded within the dart barrel of the game dart, for stabilizing or balancing the game dart.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A game dart comprising:

a dart barrel including a hollow chamber formed therein, and including a front end and a rear end each having a screw hole formed therein, a ballast retained in said chamber of said dart barrel, said screw holes of said dart barrel including an inner diameter smaller than that of said chamber of said dart barrel, to form an inner peripheral shoulder in each of said ends of said dart barrel, and to engage with said ballast, and to anchor and retain said ballast within said hollow chamber of said dart barrel, a dart point including a threaded coupler for detachably threading with said screw hole of said front end of said dart barrel, for detachably attaching said dart point to said front end of said dart barrel, and a longitudinal flight shaft including a threaded coupler for detachably threading with said screw hole of said rear end of said dart barrel, and for detachably attaching said flight shaft to said rear end of said dart barrel, and said shaft including a trailing end having a flight provided thereon.

2. The game dart as claimed in claim 1, wherein said ballast includes two ends each having an engaging member provided therein.

3. The game dart as claimed in claim 2, wherein said engaging members of said ballast are cavities formed in said ends of said ballast.

* * * * *